US005183090A

United States Patent [19]

McClung et al.

[11] Patent Number: 5,183,090

[45] Date of Patent: Feb. 2, 1993

[54] PANEL EDGE CONSTRUCTION

[75] Inventors: Duane G. McClung, Kalamazoo; Thomas C. Mueller, Grandville, both of Mich.

[73] Assignee: Herman Miller, Inc., Zeeland, Mich.

[21] Appl. No.: 791,082

[22] Filed: Nov. 12, 1991

Related U.S. Application Data

[62] Division of Ser. No. 584,130, Sep. 18, 1990, Pat. No. 5,085,027.

[51] Int. Cl.[5] ..... B27D 1/00

[52] U.S. Cl. ..... 144/350; 52/821; 144/349; 144/351; 428/192

[58] Field of Search ..... 52/309.1, 309.15, 586, 52/783, 811, 821; 108/150; 428/47, 48, 50, 58, 60, 106, 192; 144/347, 349, 350, 351

[56] References Cited

U.S. PATENT DOCUMENTS 1,337,485 4/1920 Ruoff ..... 144/351

2,002,228 5/1935 Myercord et al. ..... 144/347

*Primary Examiner*—W. Donald Bray

*Attorney, Agent, or Firm*—Varnum, Riddering, Schmidt & Howlett

[57] ABSTRACT

This relates to a panel of the type which includes a core covered by veneer and generally relates to a furniture panel. Such panels have a front edge which is contoured and is generally rounded. The panel in question has a generally rounded edge which terminates at the bottom thereof in a low radius portion, i.e., on the order of 2 mm. Because of this very low radius it is virtually impossible to take a single sheet of veneer and wrap it around such a radius. The problem is solved by using two separate veneers, an upper and a lower, and where the low radius edge portion is, machining a channel in the core and filling the channel with a projecting plug which then has the projecting portion thereof machined to provide a smooth continuous surface. Additionally, in order that there may be no demarcation of materials, the plug is formed of the same material as the veneers.

9 Claims, 2 Drawing Sheets

PANEL EDGE CONSTRUCTION

This is a division of application Ser. No. 584,130 filed Sep. 18, 1990 U.S. Pat. No. 5,085,027.

BACKGROUND OF INVENTION

1. Field of the Invention

This invention relates in general to new and useful improvements in panels which include a core and which is laminated with a veneer or a high-pressure laminated plastic, and more particularly to an edge construction of such panel.

2. State of the Prior Art

It is well known to form panels, particularly panels for furniture construction, having a generally rounded edge wherein the panels are formed of a core to which a veneer such as wood veneer or plastic is applied. However, while such a panel may have a gently rounded edge, or a square cut edge to which the veneer may be readily applied, in certain specific instances it is desired that the gently curved edge terminate in a low radius edge portion. This is particularly true of European furniture which requires that any edge of a work surface have a minimum 2 mm radius formed on it. It is very difficult to wrap veneer around such a low edge radius.

It has been known to provide panels and other covered components with a nose edging. The patents to Cooper U.S. Pat. No. 718,821; Rockwell U.S. Pat. No. 1,085,358; Breese U.S. Pat. No. 1,396,554; Greiner U.S. Pat. No. 1,539,181; Meyercord et al. U.S. Pat. No. 2,002,228; Wilburn U.S. Pat. No. 3,223,056; and Tuneke et al. U.S. Pat. No. 4,570,410 disclose various forms of providing panels and the like with nose on edge defining members. However, such nose or edge defining members either have a totally different appearance from the remainder of the panel, or function to define the entire nose or edge of such a panel or the like.

SUMMARY OF THE INVENTION

In accordance with this invention, a laminated panel having a rounded edge of a relatively low radius portion is made by forming a channel in the panel in alignment with the low radius portion, placing a plug within such channel and thereafter machining the plug to the desired low radius to form a smooth contiguous surface with the veneer on the surface of the panel.

Preferably, the plug is formed of the same color material as the laminate so that the plug has the same visual appearance as the veneer.

Further, it has been found that when the plug is machined to the low radius curvature, adjacent portions of the veneer can also be slightly machined to provide for a smooth matching surface.

Finally, it has been found that if the veneer is first applied to the core and then the channel is machined in the core with the channel being in part formed by machining edge portions of the veneer, when the plug is applied to the core, the edges of the veneer will mate with the sides of the plug so as to eliminate any fissure between the veneers and the plug. The veneer and the plug form smooth contiguous surfaces which appear as a single continuous surface.

As used herein, the term "veneer" is intended to refer generically to wood veneer or high pressure plastic, such as FORMICA plastic laminate.

With the above and other objects in view that will hereinafter appear, the nature of the invention will be more clearly understood by reference to the following detailed description, the appended claims, and the several views illustrated in the accompanying drawings.

DESCRIPTION OF PREFERRED EMBODIMENT

Figure 1:
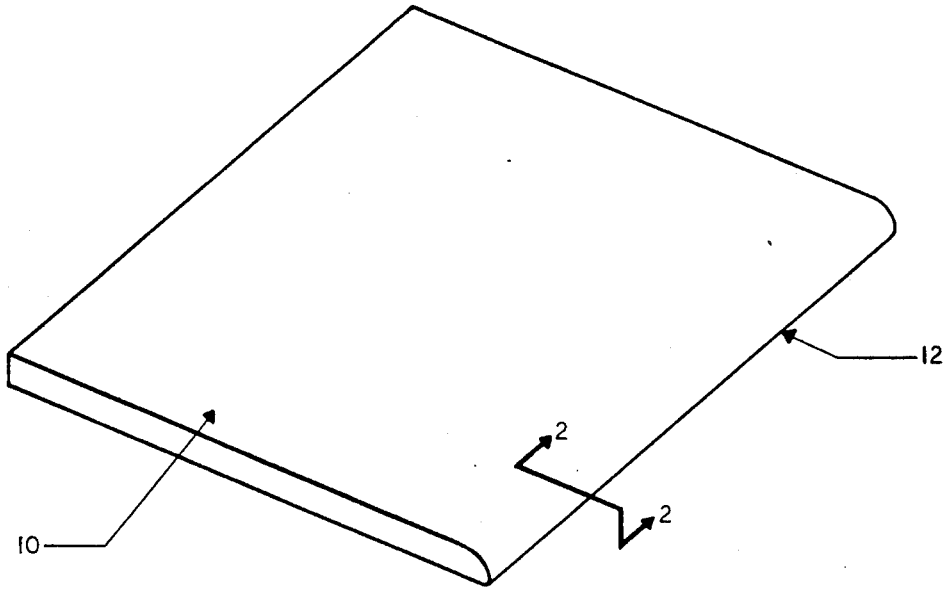
FIG. 1 is a perspective view of a furniture panel formed in accordance with this invention.

Referring now to the drawings in detail, reference is first made to FIG. 1 wherein there is illustrated a furniture panel which is formed in accordance with this invention, the panel being generally identified by the numeral 10. It will be seen that the panel 10 is provided with a rounded front end which is generally identified by the numeral 12.

Figure 2:
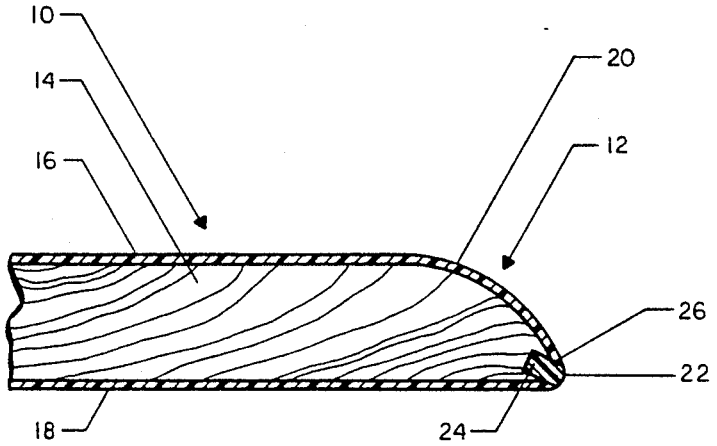
FIG. 2 is a fragmentary transverse vertical sectional view taken through the rounded edge of the panel of FIG. 1 generally along the line 2—2 of FIG. 1.

Referring now to FIG. 2, it will be seen that there are illustrated the general constructional details of the panel 10 which include a central core 14 which is in part covered by an upper veneer 16 and a lower veneer 18. At this time it is pointed out that the core 14 may be of a varied construction and may include a solid wood core, a pressed fiber core and a laminated wood core, such as plywood. On the other hand, the veneers 16, 18 can be wood veneers or a high-pressure plastic laminate such as FORMICA plastic laminate.

More specifically, the problem involved in forming the panel 10 is that the front end 12, while it is primarily in the form of a gently curving surface 20, terminates in a lower sharply rounded surface 22. As stated above, in European applications, the surface 22 will have a radius of at least 2 mm. It will be readily apparent that it is virtually impossible to bend a thin wood or plastic veneer around such a low radius and, therefore, the upper veneer 16 and the lower veneer 18 must be separate.

This invention relates to the solving of the problem as to how to provide the low radius edge portion 22 while at the same time providing an appearance of a continuous surface.

It will be apparent from FIG. 2 that the low radius edge portion 22 is defined by a plug 24 which is seated in a channel 26 formed in the edge of the core 14. The low radius edge portion 22 defined by the core 24 forms a continuation of the adjacent portions of the veneers 16, 18.

In order that the exposed portion of the plug 24 may have the same appearance as the adjacent portions of the veneers 16, 18, in accordance with this invention, the plug 24 is formed of the same material or same color material as the veneers 16, 18. Therefore, the only remaining problem is to join the veneers 16, 18 to the plug 24 in a manner which is not readily observable.

CONSTRUCTION OF PANEL

Figure 3:
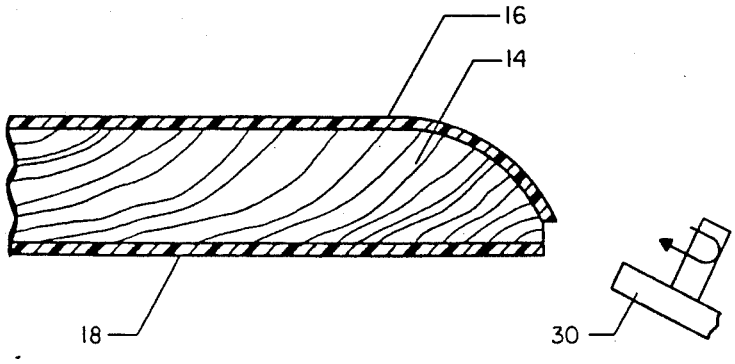
FIG. 3 is an enlarged fragmentary sectional view taken through the panel end in initial stage of construction showing the veneer applied to the core and ready for the channel to be machined within the panel.
Figure 4:
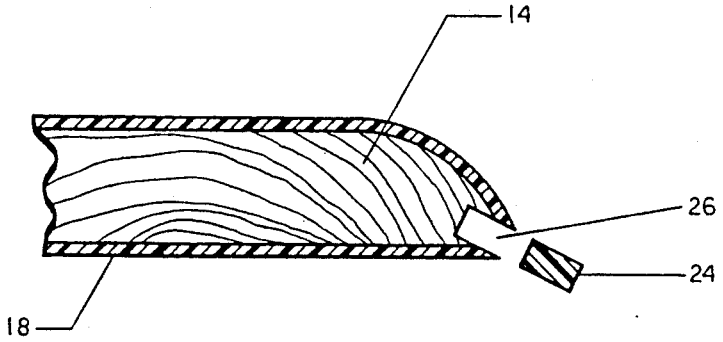
FIG. 4 is a sectional view similar to FIG. 3 and shows the panel after the channel has been machined therein.
Figure 5:
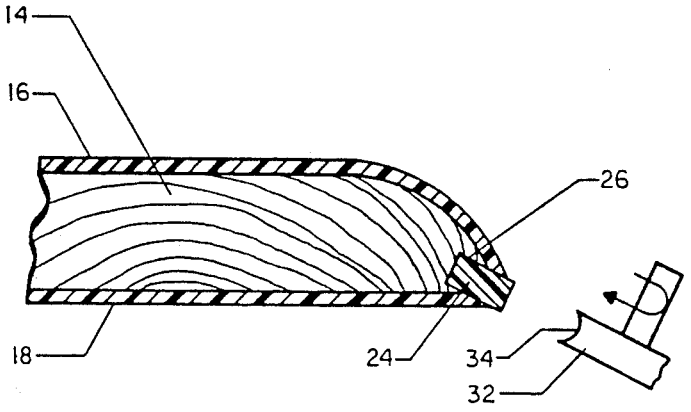
FIG. 5 is another vertical sectional view similar to FIG. 3 and shows the plug applied to the panel with the plug and adjacent portions of the laminate ready to be machined.

The manner in which the panel is formed is clearly shown in FIGS. 3–6. As shown in FIG. 3, the veneers 16, 18 are bonded to the core 14 down to and including that portion of the edge which would become the low radius curved portion 22. Then a milling cutter 30 is utilized in a conventional manner to mill the channel 26 in the core 14. In forming the channel 26, the milling cutter 30 also cuts away the adjacent edge portions of the veneers 16, 18 as is clearly shown in FIG. 4.

Next, the plug 24 is placed in the channel 26 and bonded in place. This step is followed by a suitable machining operation which has been illustrated as utilizing another milling cutter 32 having a curved face matching the low radius of the edge portion 22. However, the manner in which the low radius curved portion 22 is shaped may be varied including utilizing a plane or like wood or plastic material machining apparatus. When machining the nose of the plug 24, the surface of adjacent edge portions of the veneers 16, 18 can also be slightly machined so as to provide an essentially continuous smooth surface from the veneer 16 across the plug 24 and on to the veneer 18.

Figure 6:
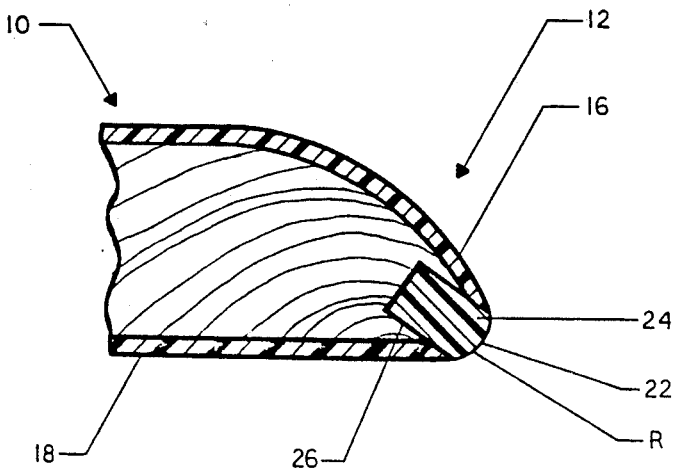
FIG. 6 is an enlarged fragmentary sectional view similar to FIG. 2 but on a larger scale showing specifically the relationship of the plug and the two laminates.

Referring now to FIG. 6, it will be seen that there is illustrated an enlarged cross sectional view of the edge of the panel 10 which also shows the relationship of the veneers 16, 18 to the plug 24. Further, it is specifically shown that the edge portion 22 has the cross sectional contour of a radius R. As previously stated, the radius R is on the order of 2 mm.

Inasmuch as the edges of the veneers 16, 18 abut the plug 24 and since the machining of the edge of the plug 24 may also include a slight machining of the adjacent surfaces of the veneers 16, 18, together with the fact that the plug 24 is formed of the same material as the veneers 16, 18, there is an imperceptible line of demarcation between the veneers 16, 18 and the plug 24. For that reason, there is no specific showing of the plug 24 in FIG. 1.

Whereas the invention has been described with reference to the formation of a small radius edge at a lower portion of a panel end, a small radius edge can be formed at a top portion of the panel end or at both the top and bottom portions of the panel end. Although it is preferable for the veneers 16 and 18 and the plug 24 to be of the same material, the invention, in its broader aspects, contemplates that the veneers 16 and 18 and the plug 24 can be of the same color but different materials or of different color materials.

While the above description of the method of forming the edge 12 of the panel 10 is the preferred method, it is to be understood that minor variations may be made in such method without departing from the spirit and scope of the invention as defined by the appended claims.

The embodiments of the invention for which an exclusive property or privilege is claimed are defined as follows:

1. A method of forming a laminated panel having a generally rounded edge terminating in a very small radius, said method comprising the steps of forming a core with a surface and an adjacent edge, forming a channel in said core edge in alignment with the intended position of said very small radius of the generally rounded edge, placing a plug in said channel, bonding a thin veneer layer to said surface of said core with said layer having an edge terminating at said plug, and then machining said very small radius on said plug to form a smooth outer surface between said veneer layer and said plug.

2. A method according to claim 1 wherein in the machining of said plug, an adjacent surface of said thin veneer layer is machined.

3. A method according to claim 1 wherein said thin veneer layer is applied to said core prior to the forming of said channel.

4. A method according to claim 1 wherein said thin layer is applied to said core prior to the forming of said channel with said channel being formed in part through said thin layer.

5. A method according to claim 1 wherein said generally rounded core comprises an upper surface and a lower surface adjacent said edge, and said veneer layer is applied to both said upper and lower surfaces.

6. A method according to claim 5 wherein said small radius of said generally rounded edge is formed at a lower portion of said generally rounded edge adjacent said lower edge.

7. A method according to claim 1 wherein said channel is formed in said core at an acute angle with respect to said surface.

8. A method according to claim 7 wherein said channel is generally of uniform cross-sectional thickness.

9. A method according to claim 1 wherein said plug is generally of uniform cross-sectional thickness.

* * * * *